US006145704A

United States Patent [19]

Geier

[11] Patent Number: 6,145,704

[45] Date of Patent: Nov. 14, 2000

[54] SPRAY CAP FOR AEROSOL CONTAINER

[75] Inventor: Adalberto Geier, Calceranica al Lago, Italy

[73] Assignee: Coster Tecnologie Speciali S.p.A., Italy

[21] Appl. No.: 09/254,542

[22] PCT Filed: Sep. 11, 1997

[86] PCT No.: PCT/EP97/04982

§ 371 Date: Mar. 9, 1999

§ 102(e) Date: Mar. 9, 1999

[87] PCT Pub. No.: WO98/11001

PCT Pub. Date: Mar. 19, 1998

[30] Foreign Application Priority Data

Nov. 11, 1996 [EP] European Pat. Off. ..... 196 36 936

[51] Int. Cl.[7] ..... B67D 5/32

[52] U.S. Cl. ..... 222/153.06; 222/402.13

[58] Field of Search ..... 222/402.13, 153.06, 222/153.11, 153.13, 402.15

[56] References Cited

U.S. PATENT DOCUMENTS

| | | | |
|---|---|---|---|
| 3,223,287 | 12/1965 | Sagarin | 222/402.13 |
| 4,513,890 | 4/1985 | Goncalves | 222/153.06 |
| 5,027,982 | 7/1991 | Demarest | 222/402.13 |

*Primary Examiner*—Philippe Derakshani
*Attorney, Agent, or Firm*—Andrus, Sceales, Starke & Sawall, LLP

[57] ABSTRACT

The invention relates to a spray cap for aerosol containers comprising an integrally formed housing (1) comprising an actuating button (2) and an actuating lever (3), both flexibly connected to the housing (1). The actuating button (2) has a drive hook (18), which moves into interaction with a drive projection (19) disposed on the actuating lever (3) when the actuating button (2) is firstly moved radially and then axially. Due to the combined movements required for actuating the aerosol container, unauthorised use is to the greatest extent excluded. The actuating button (2) and actuating lever (3) are so designed that, via a recess (16) provided in the actuating button (2), the latter can be moved axially downwards without the drive hook (18) engaging with the drive projection (19) of the actuating lever.

8 Claims, 1 Drawing Sheet

SPRAY CAP FOR AEROSOL CONTAINER

BACKGROUND OF THE INVENTION

The invention relates to a spray cap for an aerosol container, comprising a housing and an actuating lever with a tubular projection, which may be inserted in or mounted on a valve tubelet of the aerosol container, according to the preamble to patent claim 1.

Spray caps for aerosol containers are known for example from the European Patent 0 160 816. The spray cap illustrated therein comprises a cap housing and an actuating lever with a tubular projection, which may be inserted in or mounted on a valve tubelet of the aerosol container. In addition there is provided a nozzle, which communicates with the feed channel and the said projection. The known actuating button is integrally formed with the cap housing, in such a way that it is connected at its rear end by means of separating webs having deliberate breakage points, and is connected at the other end by a hinge connection to the housing. For purposes of easier manufacture, the feed channel is designed as a part of the actuating button directly above the hinge connection between the nozzle and the tubular projection. By virtue of the fact that the feed channel, as a part of the actuating button, extends directly above the hinge connection between the nozzle and the tubular projection which may be mounted or inserted in the valve tubelet of the aerosol container, a minimum constructive length of the projection is achieved. By means of the design of the spray cap according to EP 0 160 816, the use of materials is reduced, this above all in the area of the centrally located tubular projection, with the consequence of reduced cooling time and a higher ejection rate of the injection moulding machines used.

Upon actuating the button in accordance with the known spray cap by downward pressure in an axial direction towards the aerosol container, the tubular projection comes into connection with the valve tubelet of the aerosol container, so that fluid or the like located in the aerosol container can be atomised into the environment via the feed channel and the nozzle.

Problems however arise when an atomiser provided with the known spray cap is transported or stored without a protective closure, with the consequence t hat, due to unintentional exertion of pressure on the actuating button, the atomiser is actuated and liquid or the like can emerge in an undesired way. In addition, the known spray cap is not secure enough against use by unauthorised persons, e.g. children.

It is therefore the object of the invention to indicate a spray cap for aerosol containers comprising a housing and actuating lever, which offers a high degree of security in a simple way against undesired or unintentional actuation.

SUMMARY OF THE INVENTION

The object of the invention is achieved by the subject-matter according to the features of patent claim 1, the sub-claims comprising at least appropriate designs and further developments.

In accordance with the basic idea of the invention, in the proposed spray cap the actuating lever and actuating button are constructed separately in such a way that, without further manipulation, actuation, i.e. depression of the actuating button, does not lead to actuation of the valve of the aerosol container. Only by means of combined movement, entraining the actual actuating lever, is depression or opening of the valve by exertion of force on a known valve tubelet of the aerosol container effected.

Thus, according to the invention an actuating button is designed integrally with the spray cap housing and, flexibly connected therewith, an actuating button, which is separate from an actuating-lever. The actuating button has a drive hook, which co-operates with a drive projection disposed on the free end of the actuating lever. In the non-actuated condition, the drive hook and the drive projection or actuating button and actuating lever are spaced apart from each other. Axial or conventionally vertical movement of the actuating button in a downward direction, i.e. in the direction of the longitudinal axis, or towards the aerosol container, does not initiate any spray procedure, as according to the invention the drive hook of the actuating button moves past the drive projection of the actuating lever.

Only by movement of the actuating button in a radial or horizontal direction, for example by corresponding exertion of pressure by means of thumb or forefinger, will the actuating button move into such a position as, during the following downward pressure, i.e. movement in the longitudinal direction towards the aerosol container, will permit an effective connection between drive hook and drive projection, so that the content of the container is released by means of the valve known per se.

In order to limit the horizontal or radial movement, the actuating button has a stop or stop rim aligned towards the actuating lever. Both the front wall of the actuating lever, which has a nozzle, and the actuating button, which has the forward-surfaces, are integrally and flexibly connected to the cap housing, and designed in the form of an extension of the cap wall.

By means of this hinge, which is for example designed in the form of a film hinge due to the resilient properties of the plastic material used, both the horizontal and vertical or radial and axial movement of actuating button and actuating lever are possible without difficulty.

The forward surfaces of the actuating button lie substantially in the plane of the front wall of the actuating lever and are laterally spaced apart therefrom. In addition, according to the invention the actuating button has a recess, which serves to permit unhindered axial and interference-free depression of the button itself, so that depression of the button effected in the normal way does not lead to initiation of a spray procedure, i.e. distribution of the contents of the aerosol container.

According to the invention, the drive hook is so designed that it extends from a connecting section of the recess of the actuating button downwards towards the free end of the actuating lever, but laterally offset. The drive projection of the actuating lever extends towards the actuating button and is aligned upwards.

Upon movement of the actuating lever in a radial or horizontal direction, i.e. towards the outlet nozzle, the drive hook is brought into such a position that, during the subsequent depression or movement of the actuating button in the axial direction, the actuating lever can be transferred via the drive projection in the normal way into the released position. The size of the recess in the actuating button, particularly the lateral spacing between the free end of the actuating lever and the end of the actuating button, which is possessed by the drive projection, determines the necessary horizontal or radial movement until the drive projection and the drive hook are brought into engagement with one another.

Due to the separate construction according to the invention of the actuating button and actuating lever, when the button is actuated vertically alone, the spray channel is not released. Spraying is only possible if firstly the actuating button is moved radially forward and then axially downwards. In this case the drive projection and the drive hook come into effective connection, so that in the normal way the tubular projection communicates with the valve tubelet of the aerosol container, in order to release the contents to be distributed of the container.

By means of the stop or rib on the actuating button, the displacement path of the flexible actuating button in a forward direction is limited, and hooking or engagement of the drive projection and drive hook when it is depressed are simplified. After release of the actuating button, this latter, and also the actuating lever, revert into the respective initial position due to the return forces of the flexible integral connection with the cap housing.

In addition, the end of the actuating button lying opposite the hinged side can be connected by an intentional breakage point with the wall of the spray cap housing, so that a seal of guarantee is simply obtained.

BRIEF DESCRIPTION OF THE DRAWINGS

The invention will be described in more detail in the following with respect to embodiments given by way of example and with the assistance of Figures. Shown are.

DETAILED DESCRIPTION OF THE INVENTION

Figure 1B:
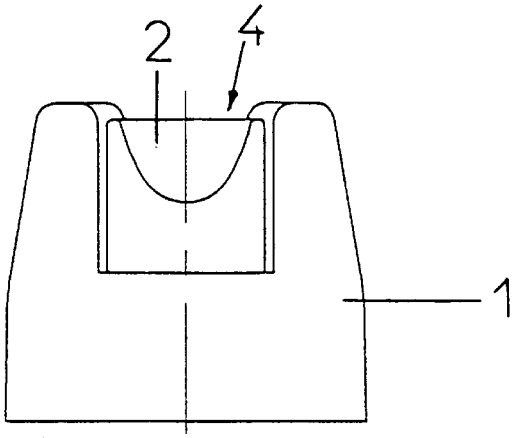
FIGS. 1*a* and 1*b*: front view and rear view of a spray cap according to the embodiment.
Figure 1A:
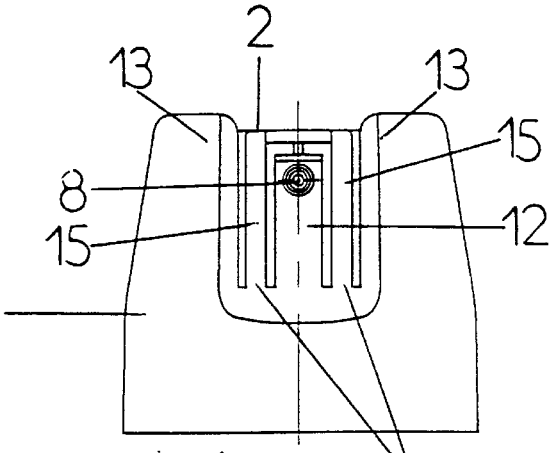

The spray cap shown in the Figures is intended for an aerosol container 10 (FIGS. 3*a,* 3*b*), which can for example be made of aluminium or the like. The spray cap has a substantially cylindrical housing 1, on which there are integrally formed both an actuating button 2 and an actuating lever 3.

The actuating lever 3 and the actuating button 2 are disposed in a cap recess 4, extending transversely over the surface, of the cylindrical housing 1. The actuating lever 3 comprises a central tubular projection 5, which may be inserted in or mounted on a valve tubelet 6 of the aerosol container 10, a nozzle 8 and a feed channel 7 connected to the latter at one end and to the tubular projection 5 at the other end, for the container contents, e.g. liquid, to be distributed.

In addition the actuating button 2, surrounding the actuating lever 3, is integrally formed with the cylindrical housing 1. The actuating button 2 is connected to the housing 1 at its rear end by means of separating webs 9 having deliberate breakage points, and at the other end via a hinged connection 11. An identical hinge connection 11*a* is provided for the actuating lever 3, which extends upwards in extension of the housing 1.

The hinged connections 11 and 11*a* are thus so formed that the front wall 12, having the nozzle 8, of the actuating lever 3, is formed as an extension of the cap wall 13, in such a way that a hinge axis extending roughly transversely to the cap longitudinal axis 14 results in the transitional area between the front wall 12 of the actuating lever 3 and the cap wall 13.

In the same sense, the hinged connection 11 for the actuating button 2 is formed as a continuation of the cap wall 13. Accordingly the actuating button 2 has front surfaces 12, which lie substantially in the plane of the front wall 12 of the actuating lever 3, and surround the latter at a lateral spacing. The actuating button 2 has a recess 16 for unhindered axial movement and interference-free depression in the direction of the cap longitudinal axis 14, i.e. in the axial direction.

Upon initial exertion of pressure on the actuating button 2, the separating webs 9 are broken and the button 2 may be moved or tilted downwards around the defined hinged connection 11. The separating webs 9 simultaneously indicate whether unauthorised use of the contents of the aerosol container has taken place or not. The said nozzle 8, to which the feed channel 7 is connected, is housed in a conventional bore or the like provided in the front wall 12 of the actuating lever 3.

In order to secure the spray cap on the aerosol container 10, the housing 1 is provided in the region of its lower edge with resiliently engaging projections 17, which interact resiliently with recesses disposed on the aerosol container 10.

Figure 2A:
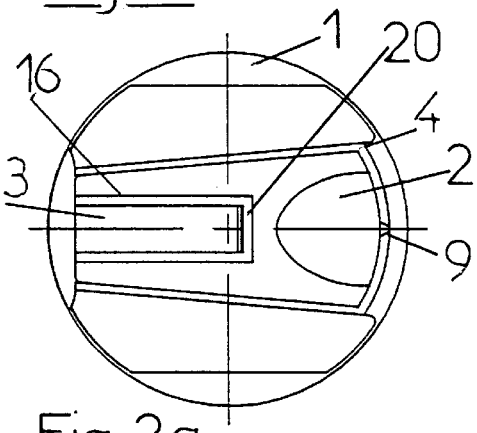
FIG. 2*a*: a plan view of the spray cap according to FIGS. 1*a* and 1*b;*

As is to be seen by reference to the plan view in FIG. 2*a,* the recess 16 in the actuating button 2 is so formed that a surrounding free section results, which permits unhindered vertical depression without carrying along the actuating lever 3.

Figure 3A:
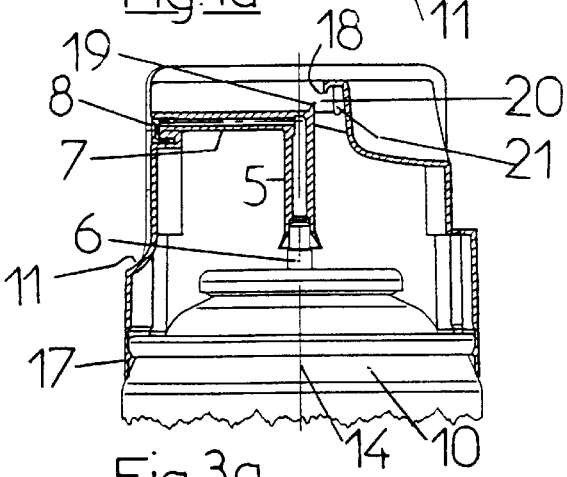
FIG. 3*a*: a longitudinal view of the spray cap in the inoperative position.
Figure 2B:
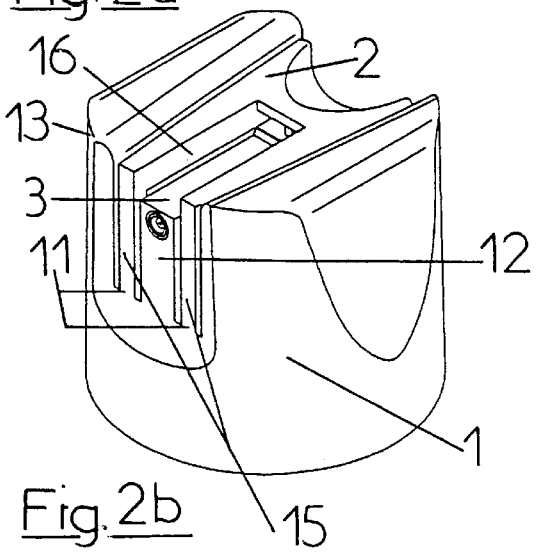
FIG. 2*b*: a perspective view-of the spray cap according to the embodiment.

In the illustration of the inoperative position of the spray cap shown in FIG. 3*a,* the integrally formed drive hook 18 can be seen. This drive hook 18 extends substantially vertically downwards and can be brought into interaction with a drive projection 19, which is cast on the actuating lever 3.

In the case when, originating from the inoperative position according to FIG. 3*c,* the actuating lever 3 is pressed downwards vertically in the axial direction, due to the slot 20 between drive hook 18 and drive projection 19, an unhindered movement is ensured, without transmission of the energy of motion to the actuating lever 3. The desired security of the spray cap against undesired use, e.g. by children, is provided by this constructive measure.

Figure 3B:
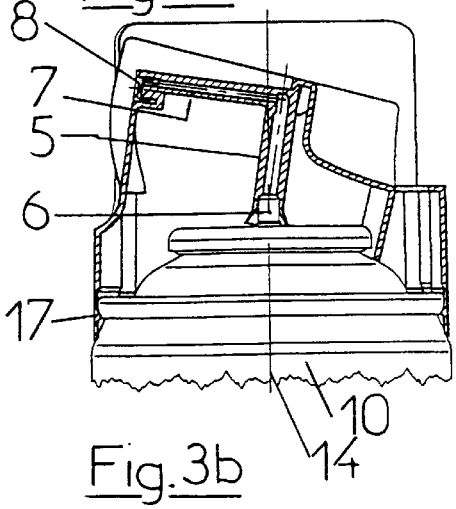
FIG. 3*b*: a longitudinal sectional view of the spray cap in the actuated condition.

Only when, with reference to FIG. 3*b,* firstly a movement of the actuating lever 3 in the radial direction, i.e. towards the nozzle 8 is effected, is the drive hook 18 brought into such a position with respect to the drive projection 19 that, during the following or connecting depression of the actuating button 2, the actuating lever 3 is carried along, so that release of the aerosol valve is possible via the tubular projection 5.

After release of the actuating button 2, the latter, inclusive of the actuating lever 3, reverts to its original position as shown in FIG. 3. This is effected due to the hinged connections 11 and 11*a* and the resilient material properties of the housing cap and its integral components. Thus actuation of-the valve tubelet 6 projecting out of the lid of the aerosol container 10 is only effected by applying a combined movement in the radial and subsequent axial direction, so that liquid can emerge under pressure from the container 10 via the tubular projection 5, the feed channel 7 and the nozzle 8.

The actuating button 2 has a stop rim 21, which serves to limit the radial or horizontal movement of the button in the direction of the actuating lever 3, so that the interaction between drive hook 18 and the drive projection 19 is reliably ensured upon application of the combined movement described.

Because the lateral cap walls 13 are vertically stepped, the actuating button 2 lies at a lower level, and the actuating lever 3 lies beneath the level of the actuating button 2, unintentional actuation of the aerosol container 10 is extensively excluded, additional security against unauthorised use being obtained by the necessary combined radial and axial movement already explained on the actuating button 2 with the purpose of entraining the actuating lever 3.

By means of the hinged connections 11 and 11*a* in combination with the selection of the cap material, preferably plastics, a corresponding resilient movement of actuating button and actuating lever with corresponding return into the inoperative or initial position may be achieved.

| List of Reference Numbers | |
|---|---|
| 1. | Housing |
| 2. | Actuating button |
| 3. | Actuating lever |
| 4. | Recess in cap |
| 5. | Tubular projection |
| 6. | Valve tubelet |
| 7. | Feed channel |
| 8. | Nozzle |
| 9. | Separating webs |
| 10. | Aerosol container |
| 11. | Hinged connection |
| 12. | Front wall of actuating lever |
| 13. | Cap wall |
| 14. | Cap longitudinal axis |
| 15. | Forward surfaces of actuating button |
| 16. | Recess in actuating button |
| 17. | Resiliently engaging projection on lower edge of housing |
| 18. | Drive hook |
| 19. | Drive projection |
| 20. | Slot |
| 21. | Stop rim |

What is claimed is:

1. A spray cap for an aerosol container including a valve tube, said spray cap and said container having a common axis, said spray cap comprising a housing (1) having an outer wall (13), an actuating lever (3) having a tubular projection (5) extending along the axis of the housing and container, said projection being constructed and configured for connection to said valve tube of the aerosol container, a nozzle (8) for discharging the aerosol contents and said lever (3) having a feed channel (7) connected to said nozzle (8) at one end and to said tubular projection (5) at the other end for discharging the contents of the container, said actuating lever (3) being integrally formed with the housing (1) and including a first hinge connection (11a) with said outer wall (13) of the housing (1), the feed channel (7) extending radially with respect to the container axis and axially displaced from the first hinge connection (11a) away from the container, an actuating button (2), a second hinge connection (11) integrally formed with the button and the wall (13) of the housing (1) and said button (2) being pivotally mounted thereby to move radially and axially of said container, the improvement wherein said actuating button (2) being spaced radially from said actuating lever and located to freely pass the actuating lever (3) when moved axially toward the container, said second hinge connection (11) being configured and constructed for radial movement of the actuating button (2) with a pivotal movement towards the container, said actuating lever being mounted in the path of said pivotal movement and engaged by said radial and pivotal movement of the button whereupon the actuating button (2) engages the actuating lever (3) to pivot same toward the container about the first hinge connection (11*a*).

2. The spray cap of claim 1, wherein the actuating button (2) includes a drive hook (18), and said actuating lever (3) includes a drive projection (19), said drive hook (18) and drive projection (19) being configured and constructed for engagement in response to said radial movement and said pivotal movement of said actuating button (2).

3. The spray cap of claim 1, wherein the actuating button (2) comprises a stop rim (21) aligned with and facing said actuating lever (3) and located to limit the radial movement of said lever.

4. The spray cap of claim 1, wherein said housing (1) includes a cap wall, said actuator lever (3) includes a front wall 12 forming a continuation of said cap wall (13), said nozzle (8) being connected to said front wall 12 as a connected continuation of the cap wall (13) of the housing (1), said connection of said front wall (12) to said cap wall (13) defining said hinge axis (11) extending substantially transversely to the cap axis (14) at a transitional area between the front wall (12) of the actuating lever (3) and the cap wall (13), said actuating button (2) having front surfaces (15) which lie substantially in the plane of the front wall (12) of the actuating lever (3), and adjacent thereto at a lateral spacing, said front surfaces (15) of said button forming said second hinge connection (11) as a continuation of the cap wall (13).

5. The spray cap of claim 1, wherein the actuating button (2) has a recess (16) aligned with said lever (3) and nozzle (8) and constructed for said free axial movement and interference-free depression of said button.

6. The spray cap of claim 2, having said drive hook (18) located within said recess (16) and extending axially toward the free end of the actuating lever (3).

7. The spray cap of claim 6, wherein said actuating lever (3) includes a drive projection 19 extending axially towards the actuating button (2) and in the path of said drive hook (18) with said pivotal movement of said button.

8. The spray cap of claim 7, wherein said actuating button is movable on said hinged connection (11) radially through the slot (20) in the recess (16), and a continued subsequent pivotal movement moves the drive hook (18) into engagement with the drive projection (19).

* * * * *

UNITED STATES PATENT AND TRADEMARK OFFICE

CERTIFICATE OF CORRECTION

PATENT NO. : 6,145,704
DATED : Nov. 14, 2000
INVENTOR(S) : Adalberto Geier

It is certified that error appears in the above-identified patent and that said Letters Patent is hereby corrected as shown below:

On title page, item

[30] Foreign Application Priority Data
Delete "Nov." and substitute therefore --Sept.--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*